US005725179A

United States Patent [19]

Gilman et al.

[11] Patent Number: 5,725,179

[45] Date of Patent: Mar. 10, 1998

[54] EXPANSION WAVE SPIN INDUCING GENERATOR

[75] Inventors: Stewart Gilman, Wharton, N.J.; Andrew Gowarty, Stroudsburg, Pa.; Anthony Farina, Hackettstown, N.J.

[73] Assignee: The United States of America as represented by the Secretary of the Army, Washington, D.C.

[21] Appl. No.: 743,596

[22] Filed: Nov. 4, 1996

Related U.S. Application Data

[60] Provisional application No. 60/018,349, May 3, 1996.

[51] Int. Cl.[6] ..... F42B 10/00; F42B 5/24

[52] U.S. Cl. ..... 244/3.24; 244/3.3; 102/439; 102/501

[58] Field of Search ..... 244/3.3, 3.24, 244/3.25, 3.23; 102/439, 501

[56] References Cited

U.S. PATENT DOCUMENTS

| | | | |
|---|---|---|---|
| 35,985 | 7/1862 | Woodbury et al. | 244/3.23 |
| 39,942 | 9/1863 | McMurtry | 244/3.23 |
| 2,145,508 | 1/1939 | Denoix | 244/3.23 |
| 3,430,900 | 3/1969 | Turner et al. | 244/3.25 |
| 5,125,344 | 6/1992 | Kline et al. | 244/3.3 |
| 5,233,667 | 8/1993 | Anderson | 244/3.3 |
| 5,328,130 | 7/1994 | Gilman et al. | 244/3.3 |
| 5,476,045 | 12/1995 | Chung et al. | 244/3.3 |
| 5,498,160 | 3/1996 | Farina et al. | 434/12 |

FOREIGN PATENT DOCUMENTS

| | | | |
|---|---|---|---|
| 2284855 | 5/1976 | France | 244/3.23 |
| 916933 | 8/1954 | Germany | 244/3.23 |
| 551468 | 11/1956 | Italy | 244/3.23 |
| 175059 | 8/1935 | Switzerland | 244/3.23 |

*Primary Examiner*—Michael J. Carone
*Assistant Examiner*—Theresa M. Wesson
*Attorney, Agent, or Firm*—John Moran; Michael Sachs

[57] ABSTRACT

A projectile to be, fired from a non-rifled tube includes an elongated forebody and a stabilizer secured to the tail end of the forebody for enhancing the projectile flight stability and for imparting spin to the projectile. The stabilizer includes a threaded member that extends integrally into a forward section, a peripheral channel and a grooved aft section. The forward section has a generally smooth cylindrical shape. The peripheral channel extends along the entire peripheral contour of the stabilizer and has a generally semi-circular cross-section, for generating an expansion wave and for directing air flow toward the grooved aft section. The grooved aft section is cylindrically shaped relative to a longitudinal axis, and has a predetermined number of identical, equally spaced, circumferentially positioned grooves which traverse the entire axial length of the aft section, and which are angled relative to the longitudinal axis. Each angled groove is defined by two substantially parallel side walls.

11 Claims, 2 Drawing Sheets

EXPANSION WAVE SPIN INDUCING GENERATOR

CROSS-REFERENCE TO RELATED APPLICATIONS.

The present application claims the priority of the provisional patent application Ser. No. 60/018,349, filed on May 3, 1996, entitled "Expansion Wave Spin Inducing Generator", which is incorporated herein by reference.

The invention described herein may be manufactured and used by or for the Government of the United States for governmental purposes.

FIELD OF THE INVENTION

This invention relates to a device for a projectile, or a portion of a projectile for effecting spin to the projectile in flight, after the projectile is fired from a smooth bore cannon.

BACKGROUND OF THE INVENTION

In the science of ballistics, shock waves emanating from a projectile in flight and traveling faster than the speed of sound, interfere with and break-up the flow of air close to the aft or back end of the projectile. The disruption of air flow affects the flight of the projectile. In order to compensate for, or overcome such perceived interference and to impart spin to a projectile fired from a non-rifled or smooth bore system, the projectile is manufactured to include a boom or extension which provides distance between the nose and fins. In effect, the boom ensures that the fins, which do not extend beyond the diameter of the body of the projectile, will contact intact air flow.

Alternatively, the projectile may have expanding fins. In such a case, the fins are hinged and spring loaded to the body of the projectile so that as the projectile exits the bore of a cannon on firing. The fins expand beyond the caliber or diameter of the body of the projectile to engage intact air flow causing the projectile to spin.

U.S. Pat. No. 5,328,130 to Gilman et al. describes an aft stabilizer connected to the nose of a projectile for imparting spin to the projectile. The stabilizer has two or more coaxial, adjacent, and integrally connected cylindrical segments of different diameters. The segment having the larger diameter is positioned most rearwardly of the projectile, relative to the nose of the projectile, and the periphery of this segment has circumferentially spaced angled slots for catching air moving past the projectile to spin the projectile. The segment with the smaller diameter attaches the cylindrical stabilizer to the aft end of the nose of the projectile and directs the flow of air to and through the angled slots of the segment having the larger diameter.

U.S. Pat. No. 5,498,160 to Farina et al. describes a training projectile adapted to fly with limited range. The projectile includes a main cylindrical body having a generally conical nose cone at the front end of the main body, and a tail portion extending from the rear end of the main body. The tail portion includes a flared member which flares outwardly from the rear end of the main body to a tail portion end and provides drag in flight to limit the length of the flight. The tail portion also includes means to impart spin to the projectile and thereby impart stability in flight, which means includes a plurality of slots in the flared member that are disposed at an angle relative to, the longitudinal axis to impart spin to the projectile. The projectile has its center of gravity closer to the nose than to the tail portion.

The structures described above may have satisfied their intended purpose. However, there is still a need for an improved kinetic energy projectile. For instance, fins add expense and difficulty to the manufacture of the projectile, and may require movable parts that are subject to failure. In addition, fins experience ablation due to air flow friction acting against the fins, thus reducing the accuracy of the projectile. Furthermore, fins occupy propellant bed space, which reduces the amount of propellant available to propel the projectile.

SUMMARY OF THE INVENTION

An object of the present invention is to provide a new kinetic energy projectile capable of forming an expansion wave for generating spin and improving flight stability. The projectile may be used as a training or service projectile.

Another object of the present invention is to provide a new kinetic energy projectile which can successfully use the air flow near the aft of the projectile to spin the projectile, without a "boom" or expandable spring loaded fins.

The present projectile is less expensive to produce than comparable projectiles in that it does not require special machinery or processes to fabricate. In addition, the present projectile is less susceptible to fin ablation since its geometric configuration causes heat build up from air friction to dissipate, which, in turn, leads to improved target dispersion accuracy. Furthermore, the stabilizer occupies minimal space, which allows more propellant to be used, and consequently greater velocities and penetration to be achieved.

The foregoing and additional features and advantages of the present invention are realized by a projectile to be fired from a non-rifled tube. The projectile includes an elongated forebody and a stabilizer secured to the tail end of the forebody for enhancing the projectile flight stability and for imparting spin to the projectile. The stabilizer includes a threaded member that extends integrally into a forward section, a peripheral channel and a grooved aft section. The forward section has a generally smooth cylindrical shape. The peripheral channel extends along the entire peripheral contour of the stabilizer and has a generally semi-circular cross-section, for generating an expansion wave and for directing air flow toward the grooved aft section. The grooved aft section is cylindrically shaped relative to a longitudinal axis, and has a predetermined number of identical, equally spaced, circumferentially positioned grooves which traverse the entire axial length of the aft section, and which are angled relative to the longitudinal axis. Each angled groove is defined by two substantially parallel side walls.

BRIEF DESCRIPTION OF THE DRAWING

The above and other features of the present invention and the manner of attaining them, will become apparent, and the invention itself will be best understood, by reference to the following description and the accompanying drawing, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF THE PREFERRED EMBODIMENT

Figure 1:
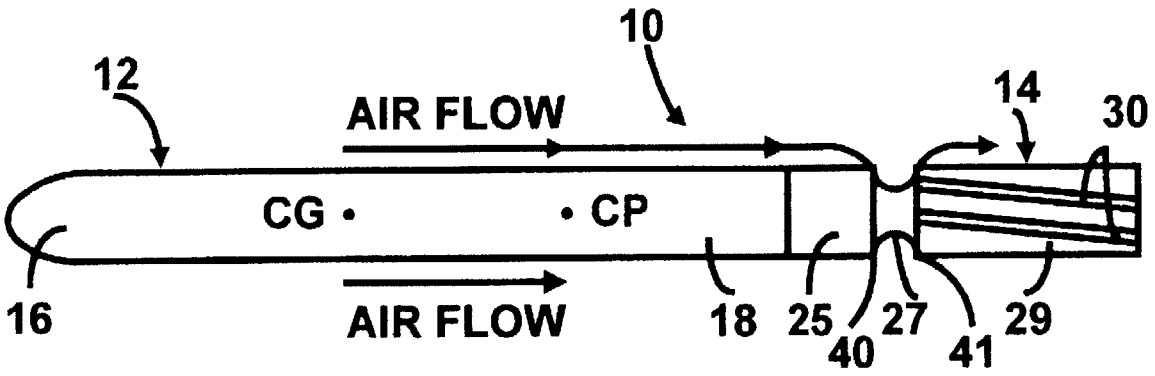
FIG. 1 is a side view of a projectile according to the present invention.

FIG. 1 illustrates a projectile 10 according to the present invention. The projectile 10 is generally formed of a forebody 12 and a stabilizer 14. The stabilizer 14 is secured to the rearwardmost or tail end of the forebody 12. The projectile 10 may be, for example a tank round for a 120 mm smooth bore system. The stabilizer 14 ensures that the projectile 10 spins when fired from such a smooth bore or non-rifled system.

The forebody 12 of the projectile 10 possesses a spine, ogive or rounded nose 16, and a rearward cylindrical portion 18 having the stabilizer 14 attached thereto. The diameter of the cylindrical portion 18 is slightly smaller than the inside diameter of the bore of tube from which the projectile is fired. An obturator (not shown) may be fastened about the cylindrical portion 18 of the forebody 12 to provide a friction fit between the bore of the cannon and the projectile 10, and thus to prevent forward thrust gasses from escaping from the bore prior to the escape of the projectile 10 when fired. The forebody 12 and the stabilizer 14 of the projectile 10 have a common longitudinal axis 20 (see FIG. 2).

Figure 2:
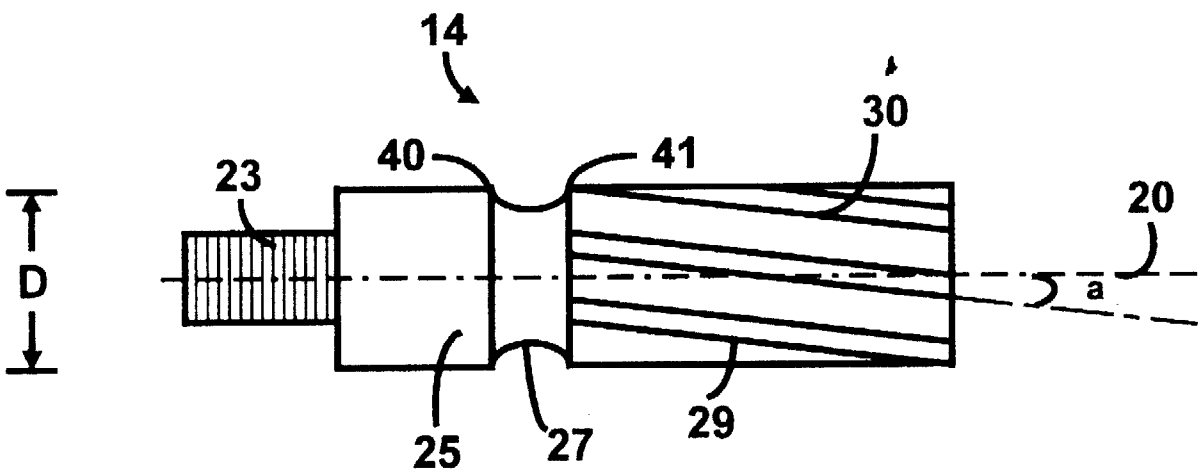
FIG. 2 is an enlarged side view of a stabilizer forming part of the projectile of FIG. 1.

FIG. 2 shows an enlarged view of the stabilizer 14. The stabilizer 14 is generally cylindrical and has a substantially uniform outer diameter "D" along most of its axial length. The outer diameter "D" of the stabilizer 14 may be substantially similar or identical to the diameter of the cylindrical portion 18, and is slightly smaller than the inner diameter of the bore of the cannon from which the projectile is fired. For instance, if the projectile 10 is for a 120 mm smooth bore system, the outer diameter "D" of the stabilizer 14, and thus of the projectile 10 (other than the obturator) has a diameter of approximately 119.3 mm.

The stabilizer 14 has a threaded or connecting member 23 that extends integrally into a smooth forward section 25, a peripheral channel 27 and a grooved aft section 29. The diameter of the threaded member 23 is not critical, so brig as it is not greater than the outer diameter "D" of the stabilizer 14. The threaded member 23 connects the stabilizer 14 of the invention to a complimentary connecting member, not shown, of the forebody 12. The threaded member 23 may alternatively be a bayonet mount (not shown) or any suitable device for ensuring the integrity of the projectile 10.

The forward section 25 is cylindrical and smooth. It contains no channels or grooves on its outer surface, so as not to disturb the air flow before it reaches the peripheral channel 27. The axial length of the forward section 25 varies with the projectile design, and may for instance range between 7.7 mm and 76.2 mm.

The peripheral channel 27 is an important feature of the present invention. It extends along the entire peripheral contour of the stabilizer 14, and has a generally semi-circular cross-section along the longitudinal axis 20. The axial length of the peripheral channel 27, i.e., the diameter of the semi-circular cross-section, varies with the design objectives. In one embodiment, the axial length may range between 6.35 mm and 12.7 mm, with the understanding that other dimensions could alternatively be used. The peripheral channel 27 generates an expansion wave and directs the air flow toward the grooved aft section 29. As will be explained further below, such flow provides the necessary stability and spin torque.

Figure 3:
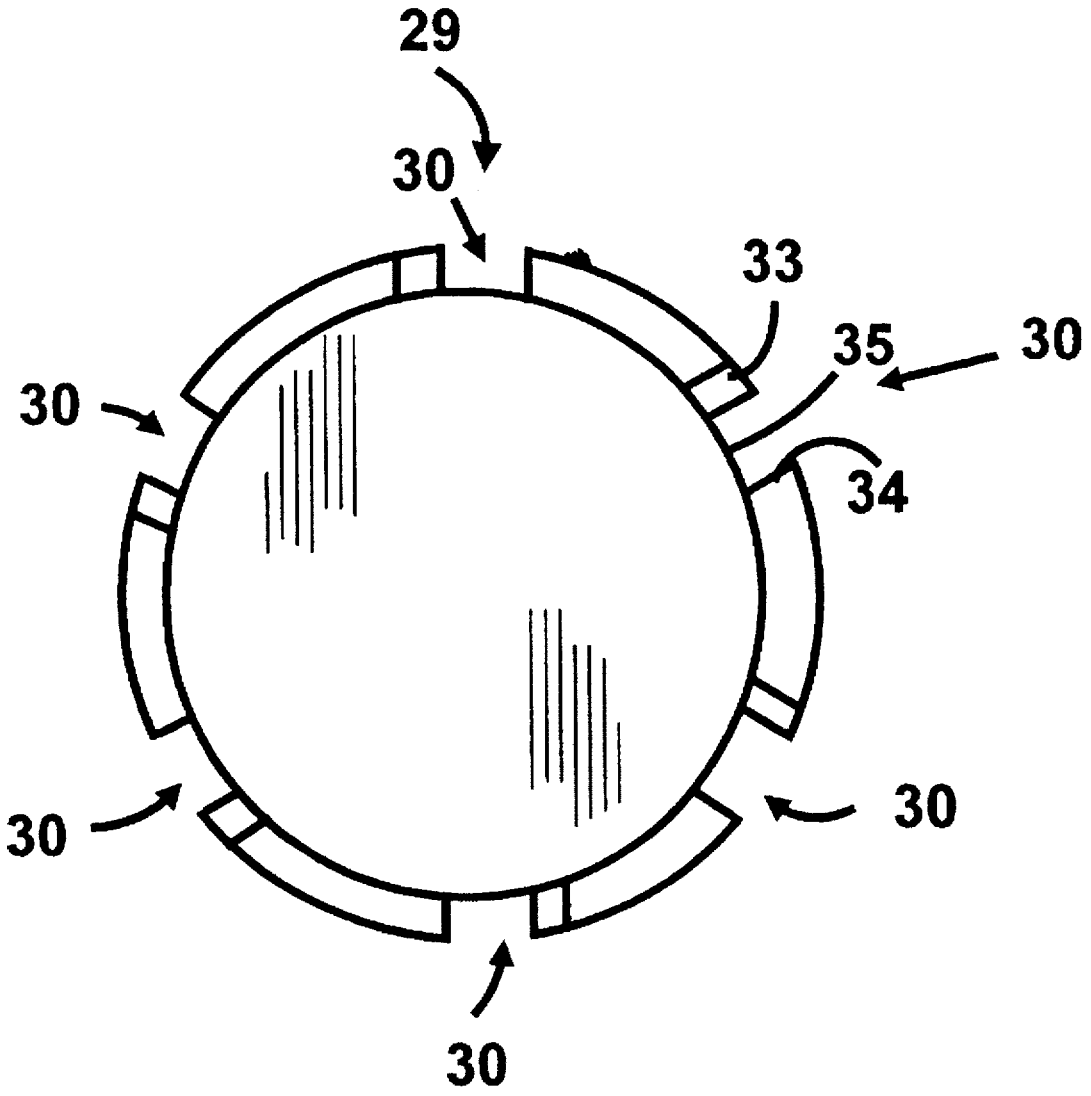
FIG. 3 is a greatly enlarged sectional view of the stabilizer of FIG. 2, taken along line 3—3.

With reference to FIGS. 2 and 3, the grooved aft section 29 is cylindrical and has equally spaced, circumferentially positioned, angled grooves 30 or air flow-through channels, which traverse the entire axial length of the aft section 29. The angled grooves 30 are defined by substantially parallel side walls 33, 34, separated by a surface 35 which may be either planar or arcuately shaped. The groove width, or more accurately the perpendicular distance between the side walls 33, 34 may vary with the design objectives, such as the number of the angled grooves 30, but may generally range between 1 mm, and D/2, where it will be recalled, D is the outer diameter of stabilizer 14. The side walls 33, 34 are sloped relative to the longitudinal axis 20 of the projectile 10, creating angled grooves 30.

The angled grooves 30 are equally spaced apart about the periphery of the stabilizer 14. While only six angled grooves 30 are shown for the purpose of illustration, it should be clear that a different number may alternatively be selected. For instance, the number of angled grooves 30 may range between 3 and 8. The angle "a" of the groove walls 33, 34 relative to the longitudinal axis 20 of the stabilizer 14 may be any suitable angle between 0 degree and 90 degrees provided it renders an acceptable projectile dispersion while avoiding projectile spin yaw resonance. Preferably, the angle "a" varies between approximately 5 degrees and 40 degrees, and most preferably, for the 120 mm caliber system, the angle is 15 degrees. The depth of the angled grooves varies, but in an exemplary embodiment, it could be about the same as the length of the peripheral channel 27.

In operation, as the projectile 10 exits the bore of the non-rifled cannon, above the speed of sound, air flows over the axial length of the forebody 12 and is directed into the peripheral channel 27 for generating an expansion wave at the leading edge 40 of the peripheral channel 27. This expansion wave redirects the turbulent airflow toward the angled grooves 30. As air exits the peripheral channel 27, a shock wave is initiated at the trailing edge 41 of the peripheral channel 27, and air passes through the angled grooves 30 and exerts a spinning force on the groove walls 33, 34, causing the projectile 10 to spin in a predetermined direction, such as the clockwise direction when viewed from the rear. By reversing the slope of the groove walls 33, 34 the projectile 10 will rotate in the other direction.

The stabilizer 14 improves flight stability by optimizing the separation between the center of gravity CG of the entire projectile 10 and the center of pressure CP (FIG. 1). As used herein, the center of pressure CP is the point at which the normal force on the projectile 10 can be set to act to return the projectile 10 toward a zero angle of attack. The normal force acts along the perpendicular direction to the longitudinal axis 20 of the projectile 10. In order to achieve optimal flight stability, the center of gravity CG is located as close as possible toward the nose of the projectile 10, while the center of pressure CP is located as close as possible to the stabilizer 14. The separation distance between the center of gravity CG and the center of pressure CP changes with the configuration of the projectile; however, in a preferred embodiment, such separation distance is approximately ten percent of the projectile total length.

The expansion wave created by the peripheral channel 27 directs the air flow toward the aft section 29, and increases the air flow over the aft body. As a result, the expansion wave increases the normal force on the stabilizer 14, which causes the center of pressure CP to move closer to the stabilizer 14 for effecting optimal flight stability. By varying the radius or length of the peripheral channel 27 the drag and stability characteristics of the: projectile 10 can be modified.

The stabilizer 14 may be machined from a solid piece of aluminum or other suitable materials, such as light and malleable metals, plastic, plastic composites, steel, titanium, etc. The peripheral channel 27 and the angled grooves 30 may be milled or formed using commonly available fabrication methods. In an exemplary design, the total stabilizer length, including the threaded member 23 is approximately 15.87 cm, which is about ¼ the total length of the projectile 10. In such an embodiment the length of the threaded member 23 is approximately 2.54 cm.

According to another embodiment, the forebody 12 includes circumferential grooves or threads, as shown in U.S. Pat. 5,498,160 described above, which is incorporated herein by reference. A tracer cavity and a tracer plug (not shown) are inserted inside the rear end of the aft section 29 of the stabilizer 14, as is generally practiced in the field.

It should be apparent that many modifications may be made to the invention without departing from the spirit and scope of the invention. Therefore, the drawings, and invention a relating to the use of the invention are presented only for the purposes of illustration and direction.

For example, the diameter of the stabilizer section may be greater or less than the diameter of the projectile forebody.

What is claimed is:

1. A projectile to be fired from a non-rifled tube, comprising in combination:

an elongated forebody;

a stabilizer including a peripheral contour and secured to a tail end of said forebody for enhancing the projectile flight stability and for imparting spin to the projectile;

said stabilizer including a connecting member that extends integrally into a forward section, a peripheral channel and a grooved aft section;

said connecting member securing said stabilizer to said forebody;

said forward section having a generally smooth cylindrical shape;

said peripheral channel extending along said peripheral contour of said stabilizer, adjacent to said forward section, having a generally semi-circular cross-section, and directly contacting said grooved aft section, for generating an expansion wave that directs air flow immediately over said grooved aft section, in order to increase the air flow over said grooved aft section, resulting in an increased lift force; and said grooved aft section being cylindrically shaped relative to a longitudinal axis, and having a plurality of equally spaced, circumferentially positioned grooves which traverse the entire axial length of said aft section, and which are angled relative to the longitudinal axis.

2. The projectile according to claim 1, wherein each of said plurality of grooves are defined by two substantially parallel side walls.

3. The projectile according to claim 2, wherein said side walls are separated by a substantially planar surface.

4. The projectile according to claim 2, wherein said side walls are separated by a substantially arc shaped surface.

5. The projectile according to claim 2, wherein said plurality of grooves include three grooves.

6. The projectile according to claim 2, wherein said plurality of grooves include eight grooves.

7. The projectile according to claim 2, wherein said plurality of grooves are substantially parallel to each other.

8. The projectile according to claim 7, wherein said plurality of grooves define an angle "a" relative to said longitudinal axis.

9. The projectile according to claim 7, wherein said angle "a" ranges between approximately 5 degrees and 40 degrees.

10. The projectile according to claim 1, wherein said peripheral channel has an axial length defined between a leading edge and a trailing edge; wherein each of said plurality of grooves has a depth; and wherein said axial length of said peripheral channel and said depth of said grooves are approximately equal.

11. The projectile of claim 1, wherein said connecting member is threaded.

* * * * *